US006619508B2

(12) United States Patent
Balcome et al.

(10) Patent No.: US 6,619,508 B2
(45) Date of Patent: Sep. 16, 2003

(54) APPARATUS FOR DISPENSING A MULTIPLE-COMPONENT SUBSTANCE FROM A MULTIPLE-BARREL CARTRIDGE

(75) Inventors: Gregory Ervin Balcome, Rochester, MN (US); Joseph Paul Kuczynski, Rochester, MN (US); Laura Marie Mulholland, Zumbro Falls, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/002,357

(22) Filed: Oct. 25, 2001

(65) Prior Publication Data

US 2003/0080152 A1 May 1, 2003

(51) Int. Cl.[7] ..... B67D 5/52

(52) U.S. Cl. ..... 222/136; 222/326; 222/333; 222/390

(58) Field of Search ..... 222/63, 136, 137, 222/145.5, 145.6, 326, 327, 333, 390

(56) References Cited

U.S. PATENT DOCUMENTS 5,022,563 A 6/1991 Marchitto et al. ..... 222/327
5,080,493 A * 1/1992 McKown et al. ..... 222/136
5,203,476 A * 4/1993 Keller ..... 222/136
5,336,014 A 8/1994 Keller ..... 403/24
5,755,362 A 5/1998 Rodriguez, Jr. et al. .... 222/391
5,765,722 A * 6/1998 Beebe et al. ..... 222/1
5,816,445 A * 10/1998 Gardos et al. ..... 222/1
5,823,389 A * 10/1998 Guzowski ..... 222/1
5,873,499 A 2/1999 Leschinsky et al. ..... 222/327
5,893,488 A 4/1999 Hoag et al. ..... 222/391
6,315,164 B1 * 11/2001 Muhlbauer et al. ..... 222/325

* cited by examiner

*Primary Examiner*—Joseph A. Kaufman
(74) *Attorney, Agent, or Firm*—Roy W. Truelson

(57) ABSTRACT

An apparatus for dispensing a multiple-component substance from a multiple-barrel cartridge (e.g., a two-barrel adhesive cartridge) includes a housing having a slot for receiving a flange of the cartridge. Preferably, the housing includes a pivoting latch that rigidly secures the flange within the slot. Plungers positioned within the housing are received by the barrels of the cartridge. A motor, which is disposed in the housing and controlled by a microprocessor, is mechanically connected to the plungers and drives the plungers within the barrels. The motor may be connected to the plungers through a lead screw assembly, for example. Preferably, the housing is handheld for ease of operation and remote from a control unit containing the microprocessor. The control unit may include a keypad and screen, operatively connected to the microprocessor, for data entry and display. The dispensing apparatus permits precise placement of two-component adhesives, for example.

17 Claims, 4 Drawing Sheets

APPARATUS FOR DISPENSING A MULTIPLE-COMPONENT SUBSTANCE FROM A MULTIPLE-BARREL CARTRIDGE

FIELD OF THE INVENTION

The present invention relates in general to dispensing guns for dispensing substances contained in cartridges. More particularly, the present invention relates to an apparatus for dispensing a multiple-component substance (e.g., a two-component adhesive) from a multiple-barrel cartridge.

BACKGROUND

Conventional multiple-component adhesives typically exhibit limited pot life at room temperature subsequent to mixing. Therefore, conventional multiple-component adhesives must typically either be pre-mixed and frozen until use or mixed just prior to use (e.g., using a multiple-barrel cartridge that mixes the components of the adhesive in a static dispersion tube). In the first case, the conventional multiple-component adhesive is typically pre-mixed, packaged into a suitably sized single-barrel syringe, and frozen (e.g., –40 C.) until thawed for use. When ready for use, the syringe containing the pre-mixed adhesive is thawed and mounted to a conventional dispensing tool. Such conventional dispensing tools may employ, for example, an air-actuated piston or a rotary screw to drive a plunger through the barrel of the syringe. Unfortunately, such conventional dispensing tools do not accommodate multiple-barrel syringes or cartridges. Because the pre-mixed adhesive in a non-frozen state possesses limited pot life (e.g., 5–15 minutes), the pre-mixed volume must be small enough to ensure that the entire single-barrel syringe will be used without delay. This process is cumbersome and tends to result in wasted adhesive.

Alternatively, the conventional multiple-component adhesive may be mixed just prior to use as mentioned above. Typically, this is accomplished by using a multiple-barrel cartridge that mixes the components of the adhesive in a static dispersion tube. Many conventional multiple-component adhesives are packaged in a cartridge that includes multiple barrels. A dual-component adhesive from a dual-barrel cartridge, for example, may be dispensed using a conventional "caulk gun" modified to receive the dual-barrel cartridge. Unfortunately, such conventional caulk guns typically include hand-operated ratchet mechanisms that do not readily permit precise placement of the adhesive bead.

Therefore, there exists a need to provide an enhanced apparatus for dispensing a multiple-component substance from a multiple-barrel cartridge.

SUMMARY OF THE INVENTION

An object of the present invention is to provide an enhanced apparatus for dispensing a multiple-component substance from a multiple-barrel cartridge that addresses these and other problems associated with the prior art.

Another object of the present invention is to provide an enhanced apparatus for dispensing a multiple-component substance from a multiple-barrel cartridge that promotes precise placement of the adhesive bead.

These and other objects of the present invention are achieved by providing an enhanced apparatus for dispensing a multiple-component substance from a multiple-barrel cartridge (e.g., a two-barrel adhesive cartridge) that includes a housing having a slot for receiving a flange of the cartridge. Preferably, the housing includes a pivoting latch that rigidly secures the flange within the slot. Plungers positioned within the housing are received by the barrels of the cartridge. A motor, which is disposed in the housing and controlled by a microprocessor, is mechanically connected to the plungers and drives the plungers within the barrels. The motor may be connected to the plungers through a lead screw assembly, for example. Preferably, the housing is handheld for ease of operation and remote from a control unit containing the microprocessor. The control unit may include a keypad and screen, operatively connected to the microprocessor, for data entry and display. The dispensing apparatus permits precise placement of two-component adhesives packaged in conventional dual-barrel cartridges, for example.

BRIEF DESCRIPTION OF THE DRAWINGS

The present invention together with the above and other objects and advantages can best be understood from the following detailed description of the embodiments of the invention illustrated in the drawings, wherein like reference numerals denote like elements.

DETAILED DESCRIPTION OF THE PREFERRED EMBODIMENTS

OVERVIEW

The present invention is directed to an apparatus for dispensing a multiple-component substance from a multiple-barrel cartridge (e.g., a two-barrel adhesive cartridge) that includes a housing having a slot for receiving a flange of the cartridge. Preferably, the housing includes a pivoting latch that rigidly secures the flange within the slot. Plungers positioned within the housing are received by the barrels of the cartridge. A motor, which is disposed in the housing and controlled by a microprocessor, is mechanically connected to the plungers and drives the plungers within the barrels. The motor may be connected to the plungers through a lead screw assembly, for example. Preferably, the housing is handheld for ease of operation and remote from a control unit containing the microprocessor. The control unit may include a keypad and screen, operatively connected to the microprocessor, for data entry and display. The dispensing apparatus permits precise placement of two-component adhesives packaged in conventional dual-barrel cartridges, for example.

DISPENSING APPARATUS

Figure 1:
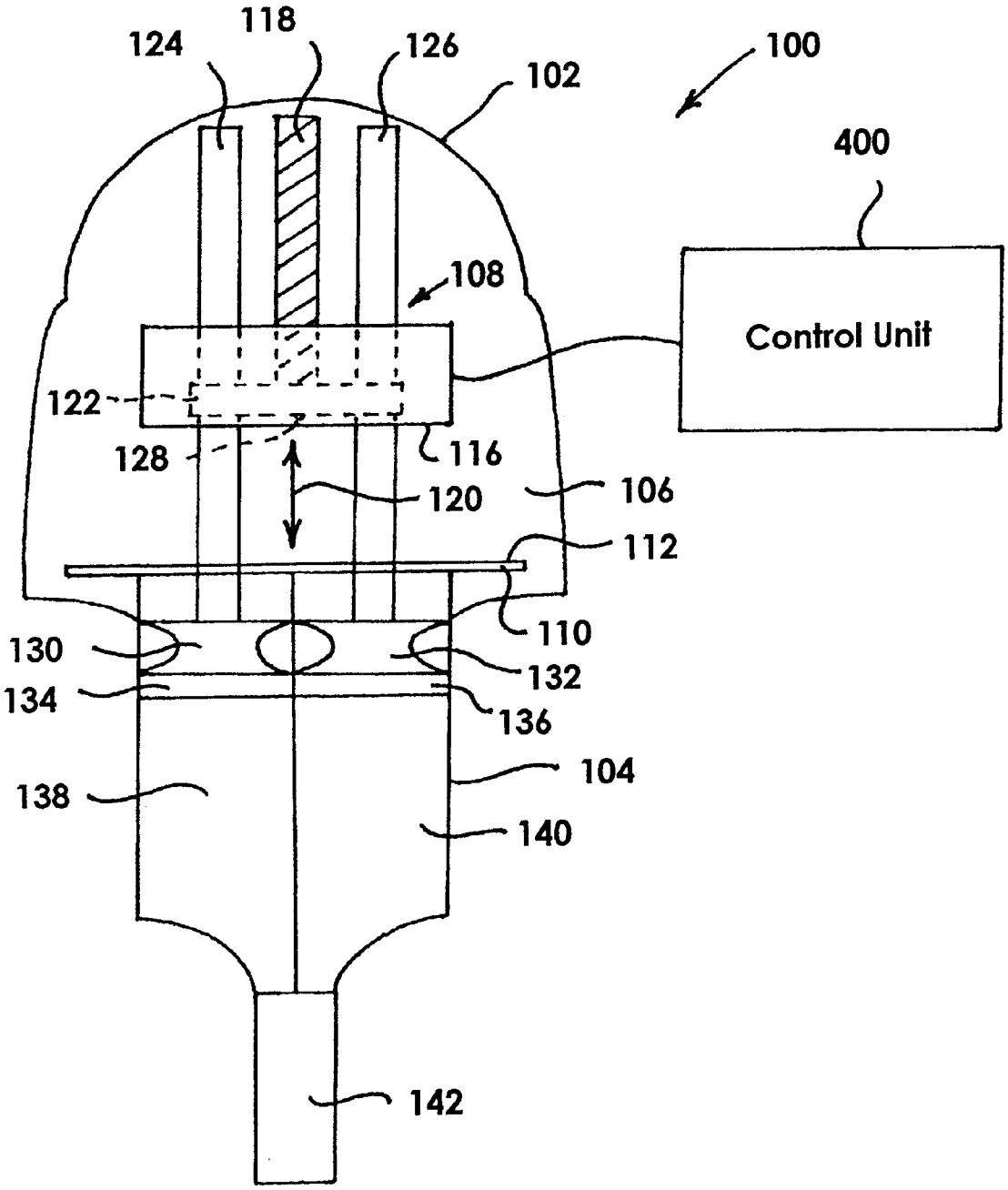
FIG. 1 is a top view of a dispensing apparatus consistent with the present invention having a top cover removed and having a conventional dual-barrel adhesive cartridge received therein.
Figure 2:
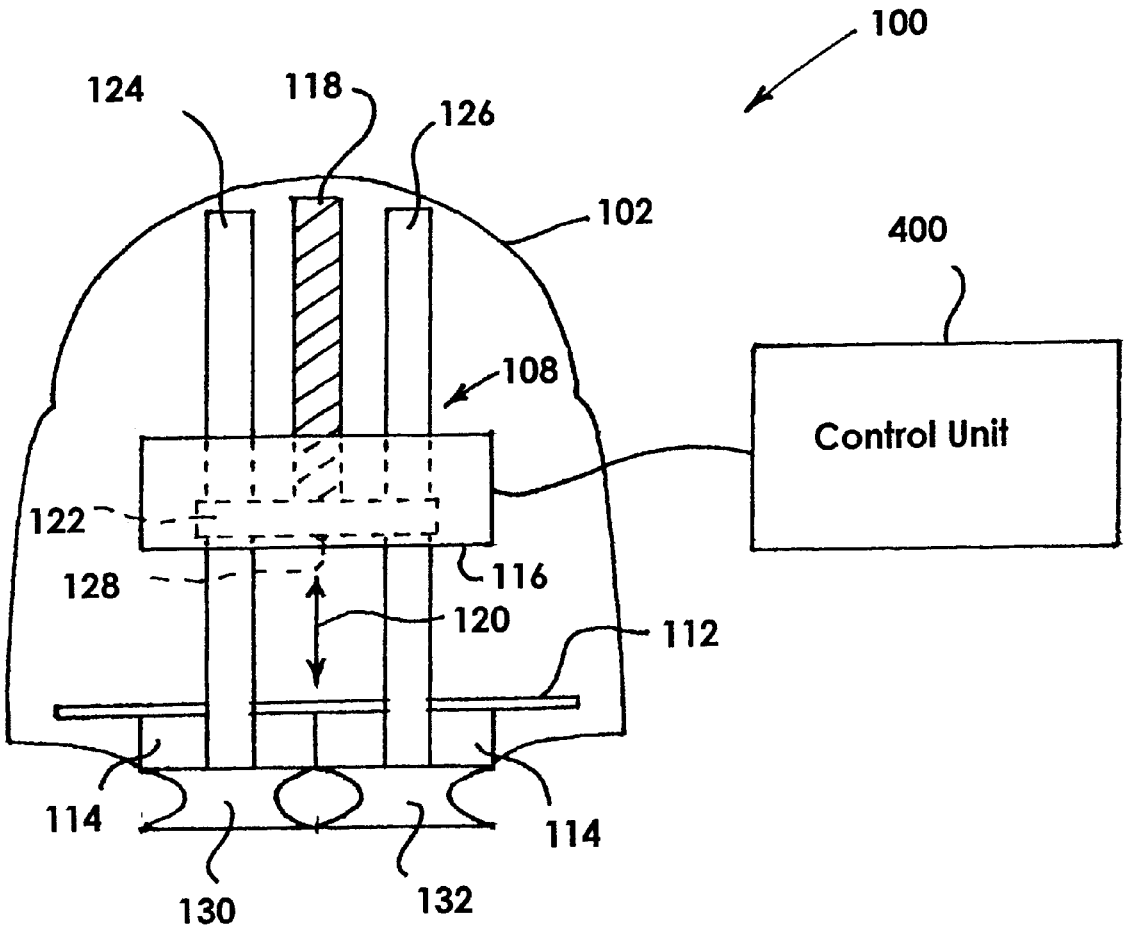
FIG. 2 is a top view of a dispensing apparatus shown in FIG. 1 prior to insertion of the conventional dual-barrel adhesive cartridge.

A dispensing apparatus 100 for dispensing a multi-component substance from a cartridge is shown in FIGS. 1–2. Dispensing apparatus 100 generally includes two main components, i.e., a dispensing unit 102 and a control unit 400. FIG. 1 is a top view of dispensing apparatus 100 having a top cover (not shown) removed from dispensing unit 102 and having a conventional dual-barrel adhesive cartridge 104 received in dispensing unit 102. FIG. 2 is a top view of dispensing apparatus 100 (again, with the top cover removed) prior to insertion of conventional dual-barrel adhesive cartridge 104 in dispensing unit 102. It should be understood, however, that the present invention may be used with other types of multiple-barrel cartridges containing multiple-component substances and is not limited to use of the particular dual-barrel adhesive cartridge shown in FIG. 1. For example, the present invention may be used with cartridges having barrels of different diameters, cartridges having more than two barrels, and cartridges having various other configurations.

Dispensing unit 102 includes a housing 106 that is generally hollow to accommodate a drive mechanism 108, which is discussed below. Although not shown, the housing 106 includes a removable top cover that mates with the portion of housing 106 shown in FIGS. 1–2. Preferably, housing 106 is constructed of a molded plastic material. The top cover preferably has the same general peripheral outline as that of the portion of housing 106 shown in FIGS. 1–2. The top cover and the portion of housing 106 shown in FIGS. 1–2 may mate through any conventional fastening mechanism, such as snap-fit, latch, hook-and-loop, screw, nut/bolt, and the like fastening mechanisms. Preferably, the top cover and the portion of housing 106 shown in FIGS. 1–2 mate through a series of snap-fit fasteners arranged along their respective outlines.

Removal of the top cover allows insertion of a lower portion of a flange 110 of dual-barrel adhesive cartridge 104 into a slot 112 in housing 106. Preferably, the top cover includes a continuation of slot 112 that receives an upper portion of flange 110 of dual-barrel adhesive cartridge 104 when the top cover is mated with the portion of housing 106 shown in FIGS. 1–2. The portion of housing 106 shown in FIGS. 1–2 preferably includes recesses 114 (FIG. 2) each contoured to receive a lower rear portion of a respective one of the barrels of dual-barrel adhesive cartridge 104. Likewise, the top cover preferably includes a continuation of recesses 114 each of which receives an upper rear portion of a respective one of the barrels of dual-barrel adhesive cartridge 104 when the top cover is mated with the portion of housing 106 shown in FIGS. 1–2. Once inserted, dual-barrel adhesive cartridge 104 is retained in housing 106 by mating the top cover with the portion of housing 106 shown in FIGS. 1–2. As discussed in detail below, housing 106 may include a pivoting latch mechanism to more rigidly secure flange 110 of dual-barrel adhesive cartridge 104 within slot 112 of housing 106.

The drive mechanism 108 includes an electrical motor 116 having a rotor (not shown), the rotation of which causes rotation of a lead screw 118, e.g., through a gear mechanism, pulley/belt arrangement, and the like. Lead screw 118 is mounted for translation in housing 106 so that it moves along the direction designated by arrow 120 as it rotates. A connector block 122 connects an end of lead screw 118 to plungers 124 and 126. Lead screw 118 is rotatably mounted to connector block 122 via a pin 128 and rotates relative to connector block 122. Connector block 122 is fixedly mounted, e.g., via an interference fit, to plungers 124 and 126. Hence, lead screw 118, connector block 122 and plungers 124 and 126 are movably mounted in housing 106 for translation in the direction designated by arrow 120. It should be understood, however, that other drive mechanisms may be used and the present invention is not limited to the particular lead-screw drive mechanism shown in FIGS. 1–2.

Plungers 124 and 126 respectively include enlarged, forward heads 130 and 132 for respectively engaging pistons 134 and 136 within barrels 138 and 140 of adhesive cartridge 104. As motor 116 is rotated in one direction (e.g., clockwise), lead screw 118 advances along with connector block 122, plungers 124 and 126, heads 130 and 132, and pistons 134 and 136, to force the dual-components of the adhesive contained within barrels 138 and 140 through a static dispersion tube 142 and thereby dispense the adhesive. Motor 116 is rotated in the other direction (e.g., counterclockwise) to withdraw lead screw 118, connector block 122, plungers 124 and 126, and heads 130 and 132.

Although not shown, dispensing unit 102 may include sensors for providing sensor data (e.g., motor rotation speed, lead screw rotation speed, plunger velocity, barrel diameter, static dispersion tube diameter, etc.).

Control unit 400 is linked to dispensing unit 102 to provide microprocessor control of motor 116. Preferably, dispensing unit 102 is hand held for ease of operation and separate from control unit 400 as shown in FIGS. 1–2. This promotes precise placement of the adhesive from dispensing unit 102. Alternatively, control unit 400 may be integrated into dispensing unit 102. As discussed below, the user may use control unit 400 to control and monitor the rate at which motor 116 rotates (e.g., this rate typically varies as a function of the amplitude of motor power supply current) and hence the flow rate of the dual-component adhesive. Control unit 400 may, for example, calculate a motor rotation speed required to provide a desired volumetric flow rate using given barrel diameter(s). Alternatively, control unit 400 may calculate a motor rotation speed required to provide a desired linear flow rate using given barrel diameter(s) and a given diameter of static dispersion tube 142.

As also discussed below, the flow of the adhesive may controlled by manipulating a user input device of control unit 400. For example, the flow of the adhesive may be started and stopped by respectively depressing and releasing a foot pedal linked to control unit 400. Moreover, the foot pedal may also control the flow rate of the adhesive in the same fashion as the foot pedal of an automobile is used to control speed.

Control unit 400 transfers motor power supply current and/or data (e.g., the desired motor rotation speed) to dispensing unit 102, as further discussed below. In the case where only data is transferred, the motor supply current may be provided from a power supply (not shown) associated with dispensing unit 102. In addition, sensor data (e.g., motor rotation speed, lead screw rotation speed, plunger velocity, barrel diameter, static dispersion tube diameter, adhesive volume, etc.) from sensors in dispensing unit 102, may be transferred from dispensing unit 102 to control unit 400. On one hand, in a relatively simple arrangement, motor power supply current may be transferred from control unit 400 to dispensing unit 102 through a wired link. On the other hand, in a relatively more complex arrangement, data may be transferred between control unit 400 and dispensing unit 102 through a wired and/or wireless link.

Figure 3:
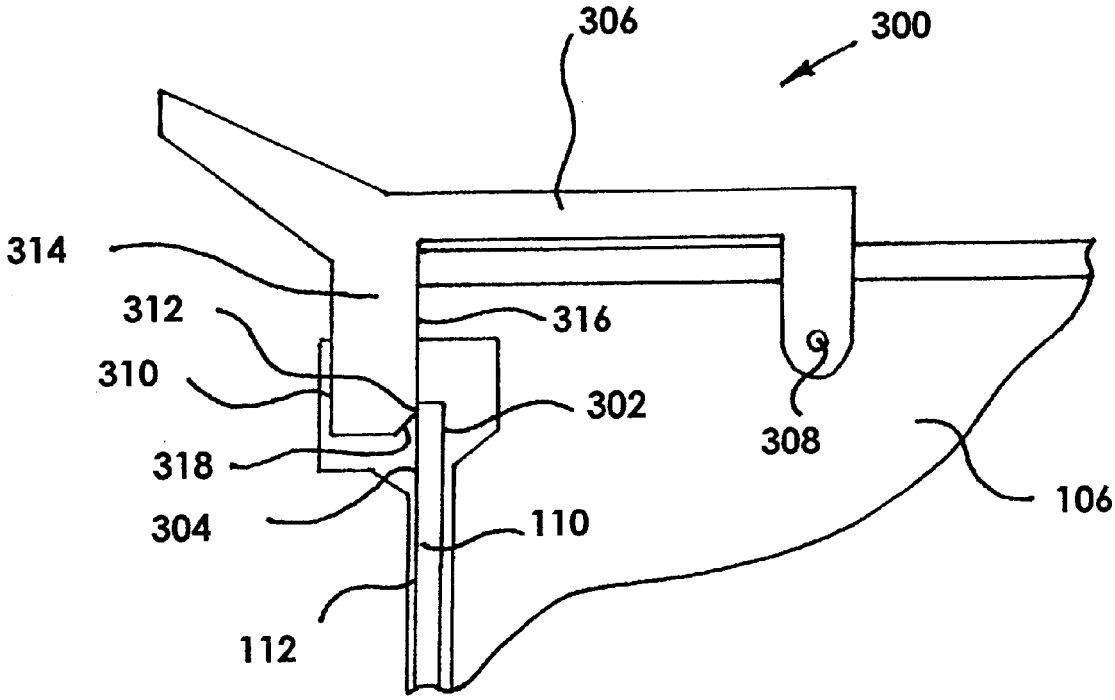
FIG. 3 is a top view of a pivoting latch that may be used to rigidly secure a flange of the conventional dual-barrel adhesive cartridge within a slot of the dispensing apparatus shown in FIGS. 1 and 2.

FIG. 3 is a top view of a pivoting latch mechanism 300 that may be used to rigidly secure flange 110 of conventional dual-barrel adhesive cartridge 104 within slot 112 of dispensing unit housing 106. Slot 112 includes a rear wall 302 and a front wall 304 arranged to accommodate the thickness of flange 110 therebetween. Dispensing unit housing 106 has a hinged latch 306 pivotably mounted thereon by a pivot pin 308. Hinged pin 306 pivots about pivot pin 308 into a recess 310 in dispensing unit housing 106 that is open to a portion 312 of front wall 304 of slot 112 to press flange 110 of cartridge 104 against rear wall 302 of the slot 112. Hinged latch 306 includes a projection 314 having a first side edge 316 and a bevelled edge 318 contiguous to first side edge 316. Flange 110 of the cartridge 104 is initially contacted by bevelled edge 318 as hinged latch 306 is pivoted into recess 310 and is subsequently contacted by first side edge 316 as hinged latch 306 is pivoted further into recess 310.

CONTROL UNIT 400 HARDWARE AND SOFTWARE ENVIRONMENT

Figure 4:
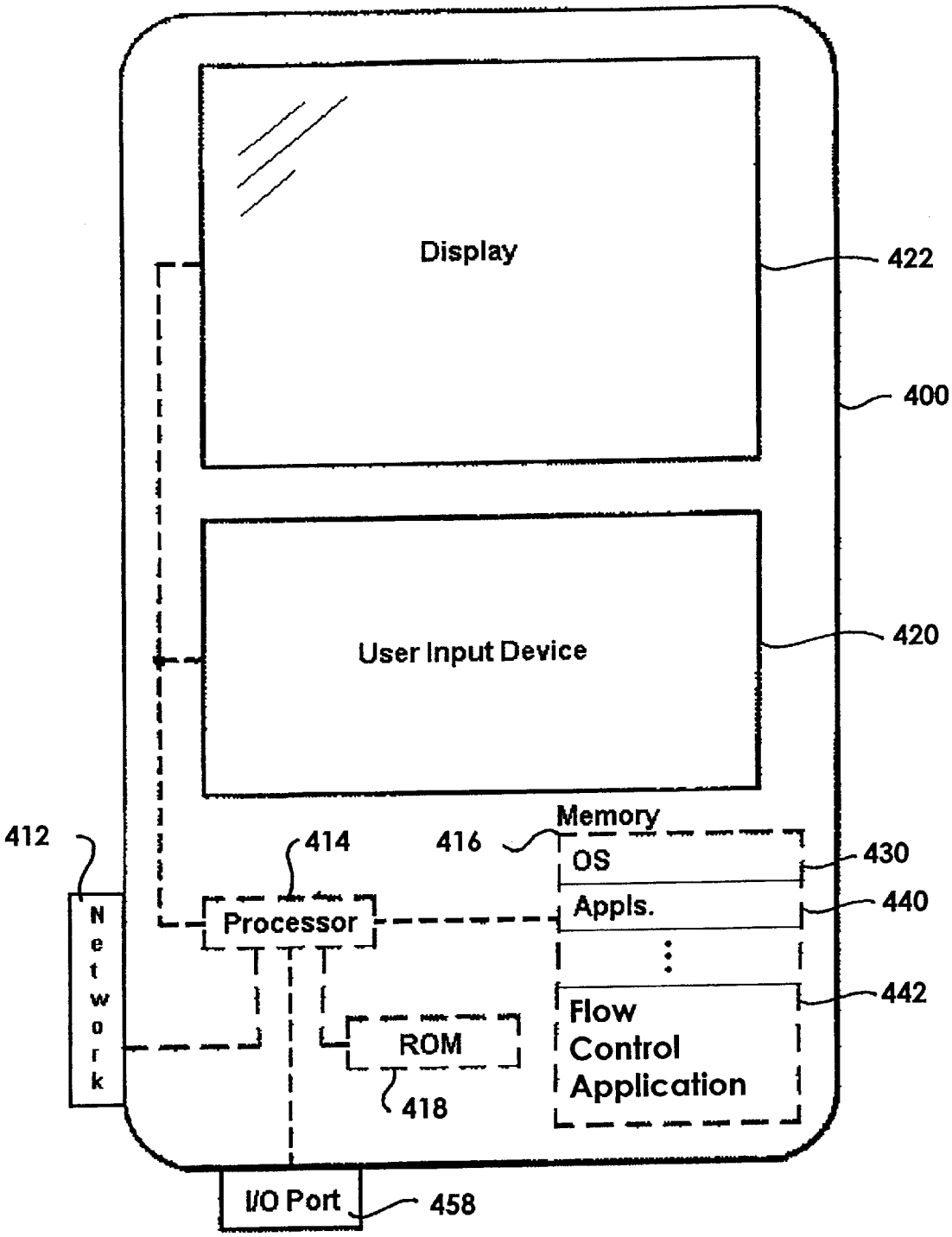
FIG. 4 is a block diagram of an exemplary hardware and software embodiment for a control unit of the dispensing apparatus shown in FIGS. 1 and 2.

FIG. 4 illustrates an exemplary hardware and software environment for control unit 400. For the purposes of the present invention, control unit 400 may represent practically any type of computer, computer system or other programmable electronic device, including a personal digital assistant (PDA), a wireless device, a notebook computer, an embedded controller, etc.

Control unit 400 may be coupled to one or more computers (e.g., a desktop or PC-based computer, workstations, a PC-based server, a minicomputer, a midrange computer, a mainframe computer, etc.) through a network 412, or may be a stand-alone device in the alternative. For example, network 412 may be a local-area network (LAN), a wide-area network (WAN), a wireless network, and a public network (e.g., the Internet). Moreover, any number of computers and other devices may be networked through the network 412.

Control unit 400 typically includes at least one processor 414 coupled to a memory 416. Processor 414 may represent one or more processors (e.g., microprocessors), and memory 416 may represent the random access memory (RAM) devices comprising the main storage of control unit 400, as well as any supplemental levels of memory, e.g., cache memories, non-volatile or backup memories (e.g., programmable or flash memories), read-only memories, etc. In addition, memory 416 may be considered to include memory storage physically located elsewhere in control unit 400, e.g., any cache memory in processor 414, as well as any storage capacity used as a virtual memory, e.g., as stored on a mass storage device, if any, or on another computer coupled to control unit 400 via network 412.

Control unit 400 typically includes a read-only memory (ROM) 418 coupled to processor 414. ROM 418 may represent one or more non-volatile programmable ROMs, such as electronically erasable programmable read-only memories (EEPROMs), flash ROMs, erasable programmable read-only memories (EPROMs), etc.

For additional storage, control unit 400 may optionally include one or more mass storage devices (not shown), e.g., a floppy or other removable disk drive, a hard disk drive, a direct access storage device (DASD), an optical drive (e.g., a CD drive, a DVD drive, etc.), and/or a tape drive, among others.

Control unit 400 also typically receives a number of inputs and outputs for communicating information externally. For interface with a user or operator, control unit 400 typically includes one or more user input devices 420 (e.g., a keypad, a foot pedal, a stylus, a keyboard, a mouse, a trackball, a joystick, a touchpad, and/or a microphone, among others) and one or more displays 422 (e.g., an LCD display panel, a speaker, and/or a CRT monitor, among others). User input device 420 may include a voice recognition system and a microphone to allow activation of various functions by voice command. Similarly, display 422 may include a voice synthesis system and a speaker to allow playback of voice messages. User input device 420 and display 422 may be combined in the form of a touch sensitive screen.

Control unit 400 includes an I/O port 458 through which motor power supply current and/or data (e.g., the desired motor rotation speed) is transferred to dispensing unit 102. In the case where only data is transferred, the motor supply current may be provided from a power supply associated with dispensing unit 102. In addition, sensor data (e.g., motor rotation speed, lead screw rotation speed, plunger velocity, barrel diameter, static dispersion tube diameter, adhesive volume, etc.) from sensors in dispensing unit 102, may be transferred from dispensing unit 102 to control unit 400 through I/O port 458. On one hand, in a relatively simple arrangement, motor power supply current may be transferred from control unit 400 to dispensing unit 102 through a wired link. On the other hand, in a relatively more complex arrangement, data may be transferred between control unit 400 and dispensing unit 102 through a wired and/or wireless link. For example, in the more complex arrangement, I/O port 458 may represent a serial port (e.g., a RS-232 interface, a RS-422 interface, a RS-423 interface, a universal serial bus (USB) port, a USB HotSync® port, etc.), a parallel port, a modem port, or a wireless port (e.g., an infrared port, radio frequency (RF) port, etc.) that communicates with a corresponding I/O port (not shown) in dispensing unit 102.

It should be appreciated that control unit 400 typically includes suitable analog and/or digital interfaces between processor 414 and each of network 412, memory 416, ROM 418 and I/O port 458, as is well known in the art.

Control unit 400 operates under the control of an operating system 430, and executes various computer software applications, components, programs, objects, modules, etc. (e.g., executable programs 440–442, among others). Moreover, various applications, components, programs, objects, modules, etc. may also execute on one or more processors in another computer coupled to control unit 400 via network 412, e.g., in a distributed or client-server computing environment, whereby the processing required to implement the functions of a computer program may be allocated to multiple computers over a network.

Included among the programs executed by control unit 400 is a flow control application 442. The user typically employs flow control application 442 to input flow control information (typically, via user input device 420) such as the desired flow rate, the barrel diameter, the static dispersion tube exit diameter, the adhesive volume, etc. and to display the flow control information (typically, via display 422) such as the actual flow rate, amount of adhesive remaining, amount of adhesive used, etc. The flow control information is typically stored in non-volatile memory, e.g., ROM 418, so that the flow control information is retained after the control unit is turned off. For example, the user may use flow control application 442 to control and monitor the rate at which the motor rotates (e.g., this rate typically varies as a function of the amplitude of motor power supply current) and hence the flow rate of the multi-component adhesive. In one example, control unit 400 may calculate a motor rotation speed required to provide a user input volumetric flow rate at a given user input barrel diameter. In another example, control unit 400 may calculate a motor rotation speed required to provide a user input linear flow rate at a given user input barrel diameter and a given user input static dispersion tube diameter.

The flow of the adhesive may be controlled by manipulating a user input device of control unit 400. For example, the flow of the adhesive may be started and stopped by respectively depressing and releasing a foot pedal linked to control unit 400. Moreover, such a foot pedal may also control the flow rate of the adhesive in the same fashion as the foot pedal of an automobile is used to control speed.

Typically, the operating system 430 and various computer software applications, components, programs, objects, modules, etc. (e.g., application programs 440–442) are loaded into memory 416 from non-volatile memory, e.g., ROM 418 and/or a mass storage device, if any. For example, relatively modest small portable computers, such as PDAs, wireless devices, embedded controllers, etc., typically do not contain a mass storage device and thus the operating system 430 and the various computer software applications, components, programs, objects, modules, etc. are typically loaded into memory 416 from ROM 418 upon power up. On the other hand, relatively robust small portable computers, such as notebook computers, typically contain a mass storage device and thus the operating system 430 and the various computer software applications, components, programs, objects, modules, etc. are typically loaded into memory 416 from the mass storage device and/or ROM 418 upon power up.

In general, the routines executed to implement the embodiments of the invention, whether implemented as part of an operating system or a specific application, component, program, object, module or sequence of instructions will be referred to herein as "computer programs", or simply "programs". The computer programs typically comprise one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has been described in the context of fully functioning computers and computer systems, those skilled in the art will appreciate that the various embodiments of the invention are capable of being distributed as a program product in a variety of forms, and that the invention applies equally regardless of the particular type of signal bearing media used to actually carry out the distribution. Examples of signal bearing media include but are not limited to recordable type media such as volatile and non-volatile memory devices, floppy and other removable disks, hard disk drives, optical disks (e.g., CD-ROM's, DVD's, etc.), among others, and transmission type media such as digital and analog communication links.

Those skilled in the art will recognize that the exemplary environment illustrated in FIG. 4 is not intended to limit the present invention. Indeed, those skilled in the art will recognize that other alternative hardware and/or software environments may be used without departing from the scope of the invention.

While this invention has been described with respect to the preferred and alternative embodiments, it will be understood by those skilled in the art that various changes in detail may be made therein without departing from the spirit, scope, and teaching of the invention. For example, in addition to dispensing multiple-component adhesives the dispensing apparatus of the present invention may be used to dispense other multiple-component materials. Accordingly, the herein disclosed invention is to be limited only as specified in the following claims.

What is claimed is:

1. A handheld dispensing apparatus for dispensing a multiple-component substance from a single multiple-barrel cartridge, comprising:

a housing, the housing having a slot for receiving a flange of the multiple-barrel cartridge;

a plurality of plungers, each plunger being positioned within the housing to be received by a respective one of the barrels of the cartridge;

a motor mechanically connected to the plurality of plungers to drive the plurality of plungers within the barrels of the cartridge, the motor being disposed in the housing and controlled by a microprocessor.

2. The dispensing apparatus as recited in claim 1, wherein the motor is mechanically connected to the plurality of plungers through a lead screw assembly.

3. The dispensing apparatus as recited in claim 1, wherein the cartridge is a two-barrel adhesive cartridge.

4. The dispensing apparatus as recited in claim 1, further comprising a control unit remote from the housing, the microprocessor being disposed in the control unit.

5. The dispensing apparatus as recited in claim 4, further comprising a foot pedal operatively connected to the microprocessor to allow a user to selectively advance the plurality of plungers within the barrels of the cartridge.

6. The dispensing apparatus as recited in claim 4, wherein the control unit includes a keypad and screen, operatively connected to the microprocessor, for data entry and display.

7. The dispensing apparatus as recited in claim 1, wherein the slot in the housing comprises a rear wall and a front wall arranged to accommodate the thickness of the flange of the cartridge therebetween, the housing having a hinged latch that pivots into a recess in the housing open to a portion of the front wall of the slot to press the flange of the cartridge against the rear wall of the slot.

8. The dispensing apparatus as recited in claim 7, wherein the hinged latch includes a projection having a first side edge and a bevelled edge contiguous to the first side edge, the flange of the cartridge being initially contacted by the bevelled edge as the hinged latch is pivoted into the recess and subsequently contacted by the first side edge as the hinged latch is pivoted further into the recess.

9. A handheld dispensing apparatus for a single, two-barrel adhesive cartridge, comprising:

a housing, the housing having a slot for receiving a flange of the two-barrel adhesive cartridge;

two plungers, each plunger being positioned within the housing to be received by a respective one of the barrels of the cartridge;

a motor connected to the plungers through a lead screw assembly to drive the plungers within the barrels of the cartridge, the motor being disposed in the housing and controlled by a microprocessor.

10. The dispensing apparatus as recited in claim 9, further comprising a control unit remote from the housing, the microprocessor being disposed in the control unit.

11. The dispensing apparatus as recited in claim 10, further comprising a foot pedal operatively connected to the microprocessor to allow a user to selectively advance the plungers within the barrels of the cartridge.

12. The dispensing apparatus as recited in claim 10, wherein the control unit includes a keypad and screen, operatively connected to the microprocessor, for data entry and display.

13. The dispensing apparatus as recited in claim 9, wherein the slot in the housing comprises a rear wall and a front wall arranged to accommodate the thickness of the flange of the cartridge therebetween, the housing having a hinged latch that pivots into a recess in the housing open to a portion of the front wall of the slot to press the flange of the cartridge against the rear wall of the slot.

14. The dispensing apparatus as recited in claim 13, wherein the hinged latch includes a projection having a first side edge and a bevelled edge contiguous to the first side edge, the flange of the cartridge being initially contacted by the bevelled edge as the hinged latch is pivoted into the recess and subsequently contacted by the first side edge as the hinged latch is pivoted further into the recess.

15. A handheld dispensing apparatus for dispensing a multiple-component substance from a single, multiple-barrel cartridge, comprising:

a housing, the housing having a slot for receiving a flange of the multiple-barrel cartridge;

a plurality of plungers, each plunger being positioned within the housing to be received by a respective one of the barrels of the cartridge;

a motor mechanically connected to the plurality of plungers to drive the plurality of plungers within the barrels of the cartridge, the motor being disposed in the housing and controlled by a microprocessor;

a control unit remote from the housing, the microprocessor being disposed in the control unit.

16. The dispensing apparatus as recited in claim 15, wherein the control unit includes a keypad and screen, operatively connected to the microprocessor, for data entry and display.

17. The dispensing apparatus as recited in claim 15, further comprising a foot pedal operatively connected to the microprocessor to allow a user to selectively advance the plurality of plungers within the barrels of the cartridge.

* * * * *